US007213713B2

(12) United States Patent
Matsui

(10) Patent No.: US 7,213,713 B2
(45) Date of Patent: May 8, 2007

(54) STORAGE SYSTEM FOR SPORTS EQUIPMENT

(75) Inventor: Darryl S. Matsui, 1630 Westminster Dr., Cardiff, CA (US) 92007

(73) Assignee: Darryl S. Matsui, Cardiff, CA (US)

( * ) Notice: Subject to any disclaimer, the term of this patent is extended or adjusted under 35 U.S.C. 154(b) by 231 days.

(21) Appl. No.: 10/993,774

(22) Filed: Nov. 20, 2004

(65) Prior Publication Data

US 2006/0108302 A1 May 25, 2006

(51) Int. Cl.
*A47F 7/00* (2006.01)

(52) U.S. Cl. ..... 211/85.7

(58) Field of Classification Search ..... 211/85.7, 211/70.5, 118, 87.01, 60.01, 62, 63, 70.8
See application file for complete search history.

(56) References Cited

U.S. PATENT DOCUMENTS 3,527,354 A * 9/1970 Sokolow ..... 211/70.5
4,037,750 A 7/1977 Box
4,271,997 A * 6/1981 Michael ..... 224/546
4,760,921 A 8/1988 Licari
5,038,942 A 8/1991 Wright
5,082,123 A 1/1992 Lamb
5,145,135 A 9/1992 Thompson
5,314,152 A 5/1994 Troy et al.
5,373,951 A 12/1994 Arnold
5,642,820 A 7/1997 Angeles
5,702,007 A 12/1997 Fritz et al.
5,833,079 A 11/1998 Roberts
6,390,309 B1 * 5/2002 Tucker ..... 211/85.7
6,637,603 B2 * 10/2003 Klein et al. ..... 211/35
6,935,517 B1 * 8/2005 Reed et al. ..... 211/85.7

* cited by examiner

*Primary Examiner*—Sarah Purol
(74) *Attorney, Agent, or Firm*—Steven G. Roeder; James P. Broder

(57) ABSTRACT

A storage system (12) for securing a first piece of sports equipment (10A) and a second piece of sports equipment (10B) to a rigid structure (14) includes a first storage subassembly (16A) and a second storage subassembly (16B). The first storage subassembly (16A) includes a left first frame (18A) and a spaced apart right first frame (18B) that are coupled to the rigid structure (14). The first frames (18A) (18B) cooperate to support the first piece of sports equipment (10A). The second storage subassembly (16B) includes a left second frame (20A) and a spaced apart right second frame (20B). The second frames (20A) (20B) are selectively coupled to the first storage subassembly (16A). The second frames (20A) (20B) cooperate to support the second piece of sports equipment (10B).

20 Claims, 7 Drawing Sheets

STORAGE SYSTEM FOR SPORTS EQUIPMENT

BACKGROUND

Sports equipment such as surfboards and snowboards are becoming increasingly popular. The storage of the surfboards and snowboards can require significant amount of space. Existing storage systems for surfboards and snowboards are not entirely satisfactory, as they do not allow for the addition or subtraction of sports equipment.

SUMMARY

The present invention is directed to storage system for securing a first piece of sports equipment and a second piece of sports equipment to a rigid structure. In one embodiment, the storage system includes a first storage subassembly and a second subassembly. The first storage subassembly includes a left first frame and a spaced apart right first frame that are fixedly coupled to the rigid structure. The first frames cooperate to support the first piece of sports equipment. The second storage subassembly includes a left second frame and a spaced apart right second frame. The second frames are selectively coupled to the first storage subassembly. The second frames cooperate to support the second piece of sports equipment.

In one embodiment, each frame includes a first coupling component and a second coupling component. In this embodiment, the second coupling component of the left second frame engages the first coupling component of the left first frame to selectively couple the left second frame to the left first frame. Somewhat similarly, the second coupling component of the right second frame engages the first coupling component of the right first frame to selectively couple the right second frame to the right first frame. Additionally, in this embodiment, the storage system can include a first component cover that covers the first coupling component of one of the second frames and a second component cover that covers the second coupling component of one of the first frames.

Further, at least one of the frames can include a base region that is positioned adjacent to the rigid structure and a cantilevering region that cantilevers away from the base region. Moreover, the cantilevering region can include a padded area that engages the piece of sports equipment.

Moreover, the present invention is directed to a method for retaining multiple pieces of sports equipment with modular capabilities for expansion and ability to transform into multiple racks at any given time.

The present invention can allow the end user to increase or decrease the amount of equipment they wish to store on one embodiment, or separate and install two or more individual rack assemblies.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
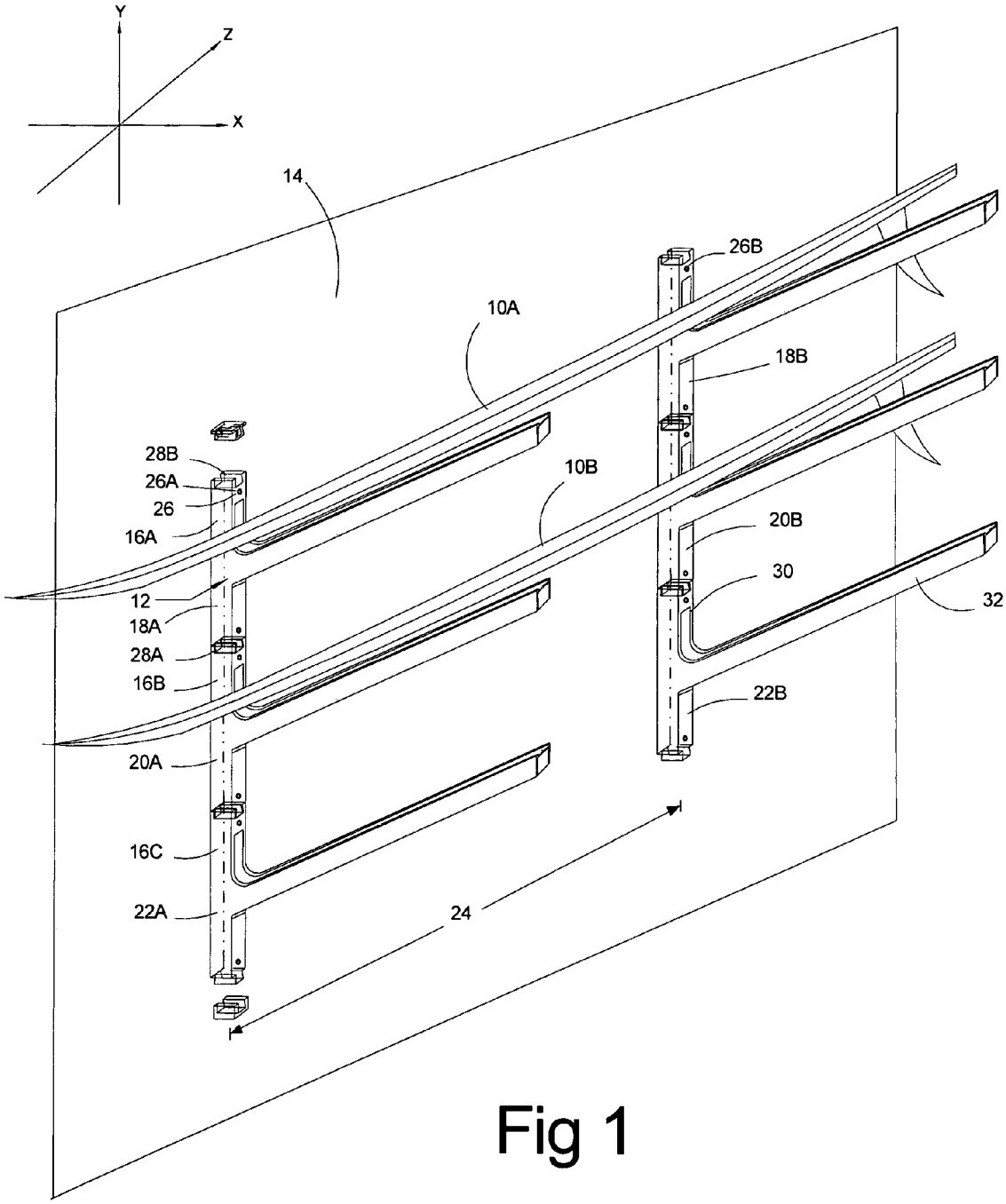
FIG. 1 is a perspective view of two pieces of sports equipment and one embodiment of a storage system having features of the present invention including a plurality of frames.

FIG. 1 is a perspective view of a first piece of sports equipment 10A, a second piece of sports equipment 10B, and a first embodiment of a storage system 12 that can be used to store the sports equipment 10A, 10B. In certain embodiments, the storage system 12 is a modular type storage assembly that can be easily expanded to store more than two pieces of sports equipment or retracted to store only one piece of sports equipment.

The type of sports equipment 10A, 10B stored on the storage system 12 can vary. For example, one or each piece of sports equipment 10A, 10B can be a fluid related piece of sports equipment such as a surfboard, a snowboard, a waterski, a wakeboard, or snowskis. Alternatively, for example, one or each piece of sports equipment 10A, 10B can be a skateboard.

The storage system 12 is secured to a rigid structure 14. With this design, the storage system 12 can be used to store the one or more pieces of sports equipment 10A, 10B on the rigid structure 14. As an example, the rigid structure 14 can be a wall or other support structure, e.g. a pair of spaced apart 2×4's.

In the FIG. 1, the storage system 12 includes a first storage subassembly 16A, a second storage subassembly 16B that is selectively secured to the first storage subassembly 16A, and a third second storage subassembly 16C that is selectively secured to the second storage subassembly 16B. Further, the storage system 12 can include one or more additional storage subassemblies (not shown) that can be selectively added to the first storage subassembly 16A. With this design, one or more storage subassemblies can be selectively added to the first storage subassembly 16A to make a modular type storage system 12 that can be easily adjusted to accommodate additional pieces of sports equipment as necessary In FIG. 1, the first storage subassembly 16A supports the first piece of sports equipment 10A, the second storage subassembly 16B supports the second piece of sports equipment 10B, and the third storage subassembly 16C is empty. Alternatively, for example, the first storage subassembly 16A and/or the second storage subassembly 16B can be empty.

The design of each storage subassembly 16A–16C can be varied to suit the types of pieces of sports equipment 10A, 10B. In FIG. 1, the design of each of the storage subassemblies 16A–16C is substantially the same. Alternatively, for example, one or more of the storage subassemblies 16A–16C can be different from one or more of the other storage subassemblies 16A–16C.

In FIG. 1, (i) the first storage subassembly 16A includes a left first frame 18A and a spaced apart right first frame 18B that cooperate to support the first piece of sports equipment 10A, (ii) the second storage subassembly 16B includes a left second frame 20A and a spaced apart right second frame 20B that cooperate to support the second piece of sports equipment 10B, and (iii) the third storage subassembly 16C includes a left third frame 22A and a spaced apart right third frame 22B that cooperate to support an additional piece of sports equipment (not shown).

The distance between the first frame and the second frame of each storage subassembly 16A–16C can be varied to suit the types of pieces of sports equipment 10A, 10B and is generally based on the distance between supporting structures. In alternative, non-exclusive embodiments, the first frame and the second frame of each storage subassembly 16A–16C are typically spaced apart a frame distance 24 that is approximately 16, 32, or 48 inches. Stated alternatively, the frame distance 24 can be between approximately 1 and 5 feet. However, the frame distance 24 can be greater or lesser than these amounts.

In one embodiment, only one of the storage subassemblies 16A–16C is fixedly secured to the rigid structure 14. For example, in FIG. 1, the first storage subassembly 16A is fixedly secured to the rigid structure 14. Further, the second and third storage subassemblies 16B, 16C are secured to the rigid structure 14 indirectly via the first storage subassembly 16A. With this design, the second and third storage subassemblies 16B, 16C can be easily added and removed from the rigid structure 14 to expand or contract the storage system 12.

In FIG. 1, the storage assembly 12 also includes a fastener assembly 26 that fixedly secures the first frames 18A, 18B to the rigid structure 14. The design of the fastener assembly 26 can vary. In FIG. 1, the fastener assembly 26 includes a left fastener 26A that fixedly secures the left first frame 18A to the rigid structure 14 and a right fastener 26B that fixedly secures the right first frame 18B to the rigid structure 14. In this embodiment, the left fastener 26A is a screw that extends through the left first frame 18A into the rigid structure 14 and the right fastener 26B is a screw that extends through the right first frame 18B into the rigid structure 14. Alternatively, for example, the fastener assembly 26 can include multiple left fasteners 26A or right fasteners 26B. Further, one or both of the fasteners 26A, 26B can have another design. For example, one or both of the fasteners 26A, 26B can be an adhesive.

As discussed above, the second storage subassembly 16B is selectively secured to the first storage subassembly 16A, and the third second storage subassembly 16C that is selectively secured to the second storage subassembly 16B. More specifically, (i) the left second frame 20A is selectively secured to the left first frame 18A and the right second frame 20B is selectively secured to the right first frame 18B, and (ii) the left third frame 22A is selectively secured to the left second frame 20A and the right third frame 22B is selectively secured to the right second frame 20B.

In one embodiment, each frame 18A–22B includes a first coupling component 28A and a second coupling component 28B that facilitate the selective coupling of the second and third subassemblies 16B, 16C to the first subassembly 16A. In this embodiment, (i) the second coupling component 28B of the left second frame 20A engages the first coupling component 28A of the left first frame 18A to selectively couple the left second frame 20A to the left first frame 18A, (ii) the second coupling component 28B of the right second frame 20B engages the first coupling component 28A of the right first frame 18B to selectively couple the right second frame 20B to the right first frame 18B, (iii) the second coupling component 28B of the left third frame 22A engages the first coupling component 28A of the left second frame 20A to selectively couple the left third frame 22A to the left second frame 20A, and (iv) the second coupling component 28B of the right third frame 22B engages the first coupling component 28A of the right second frame 20B to selectively couple the right third frame 22B to the right second frame 20B.

The design for each coupling component 28A, 28B can vary as long as the second coupling component 28B can be selectively coupled to the first coupling component 28A. As an example, when the second coupling component 28B of the left second frame 20A is coupled to the first coupling component 28A of the left first frame 18A, the left second frame 20A is inhibited from moving up and down along the rigid structure 14 (along the Y axis) relative to the left first frame 18A. However, the left second frame 20A is not inhibited from being pivoted and/or moved outward relative to the left first frame 18A to selectively couple and uncouple the frames 18A, 20A. The other frame arrangements can be coupled and uncoupled in a similar fashion.

The design of each frame 18A–22B can be varied to suit the types of pieces of sports equipment 10A, 10B. In one of embodiment, each frame 18A–22B has substantially the same size, shape and configuration. Alternatively, one or more of the frames 18A–22B can have a different size, shape and/or configuration than the other frames 18A–22B. In FIG. 1, each frame 18A–22B has substantially the same design. In this embodiment, each frame 18A–22B includes a base region 30 that is positioned adjacent to and parallel with the rigid structure 14 and a cantilevering region 32 that cantilevers away from the base region 30.

Figure 2A:
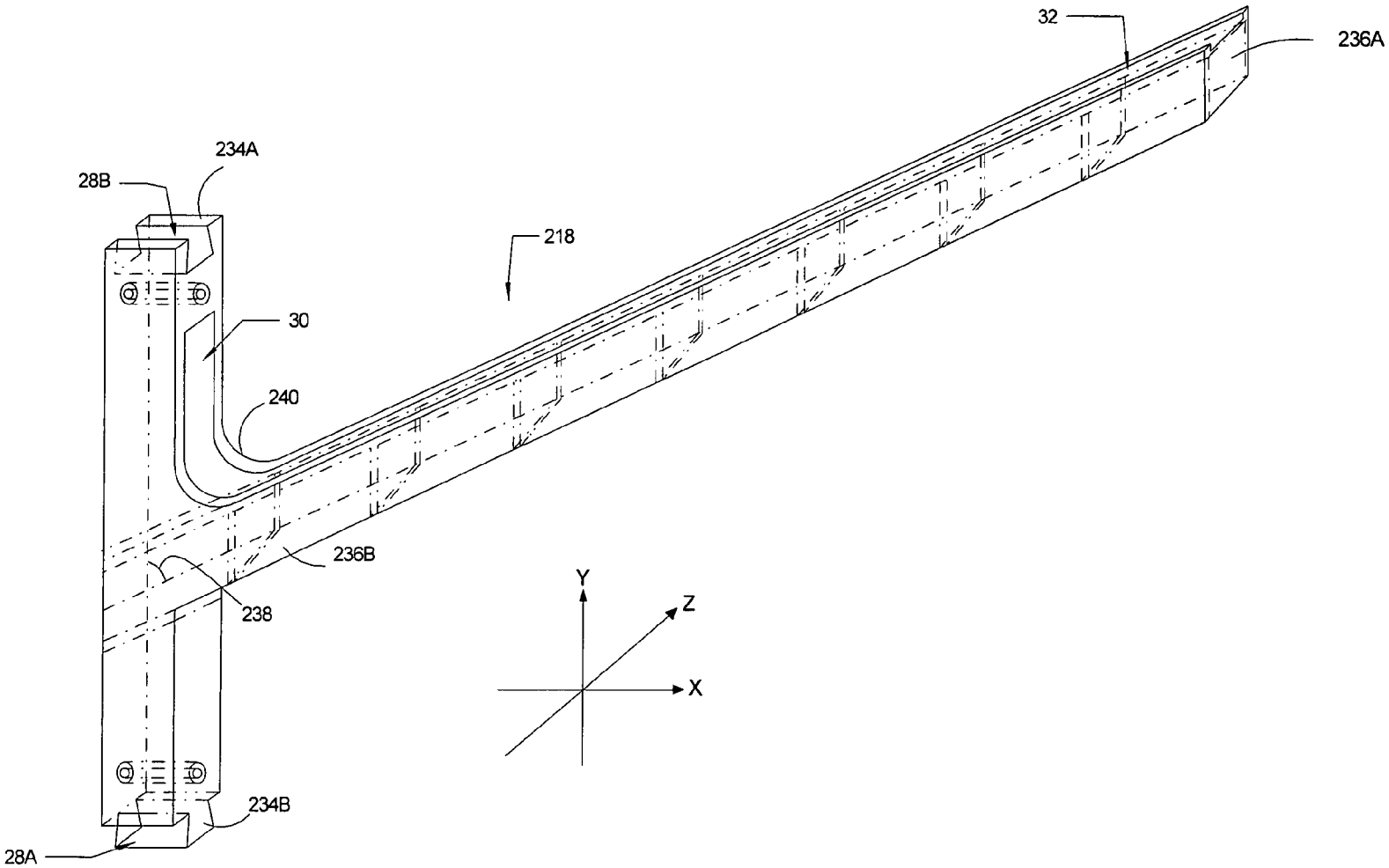
FIG. 2A is a perspective view of one of the frames of FIG. 1.

FIG. 2A is a perspective view of a frame 218 including the base region 30 and the cantilevering region 32 that can be used as one of the frames 18A–22B in FIG. 1. In this embodiment, the base region 30 and the cantilevering region 32 are manufactured as a homogeneous, one-piece component. The frame 218 can be made of a rigid material. Non-exclusive examples of suitable materials include plastic, aluminum or steel.

In FIG. 2A, the base region 30 is generally rectangular beam shaped and includes a top 234A and a bottom 234B. In this embodiment, the second coupling component 28B is positioned at the top 234A and the first coupling component 28A is positioned at the bottom 234B. Alternatively, for example, the base region 30 can have another shape. The dimensions of the base region 30 can vary. As non-exclusive embodiments, the base region 30 has a length of approximately 5, 6, 7, 8, 9 or 10 inches and a width of approximately 0.5, 0.75, 1, 1.25, 1.5, or 2 inches. However, other dimensions can be utilized.

In FIG. 2A, the cantilevering region 32 is generally rectangular beam shaped and includes a distal end 236A that is positioned away from the base region 30 and a proximal end 236B that is secured to the base region 30. Alternatively, for example, the cantilevering region 32 can have another shape. The dimensions of the cantilevering region 32 can vary. As non-exclusive embodiments, the cantilevering region 32 has a length of approximately 10, 12, 14, 16, 18, 20, 22 or 24 inches and a width of approximately 0.5, 0.75, 1, 1.25, 1.5, or 2 inches. However, other dimensions can be utilized.

In FIG. 2A, the cantilevering region 32 is connected to the base region 30 intermediate the top 234A and the bottom 234B. In one embodiment, the cantilevering region 32 is connected to the base region 30 approximately half way between the top 234A and the bottom 234B. Alternatively, the cantilevering region 32 can be connected to the base region 30 closer to the top 234A than the bottom 234B or the cantilevering region 32 can be connected to the base region 30 closer to the bottom 234B than the top 234A.

Further, in FIG. 2A, the cantilevering region 32 extends away from the base region 30 at an angle 238 that is acute. As non-exclusive embodiments, the angle 238 can be approximately 40, 50, 60, 65, 70, or 80 degrees. However, other angles can be utilized. In one embodiment, a transition 240 between the base region 30 and the cantilevering region 32 is curved. This can protect the piece of sports equipment.

Figure 2B:
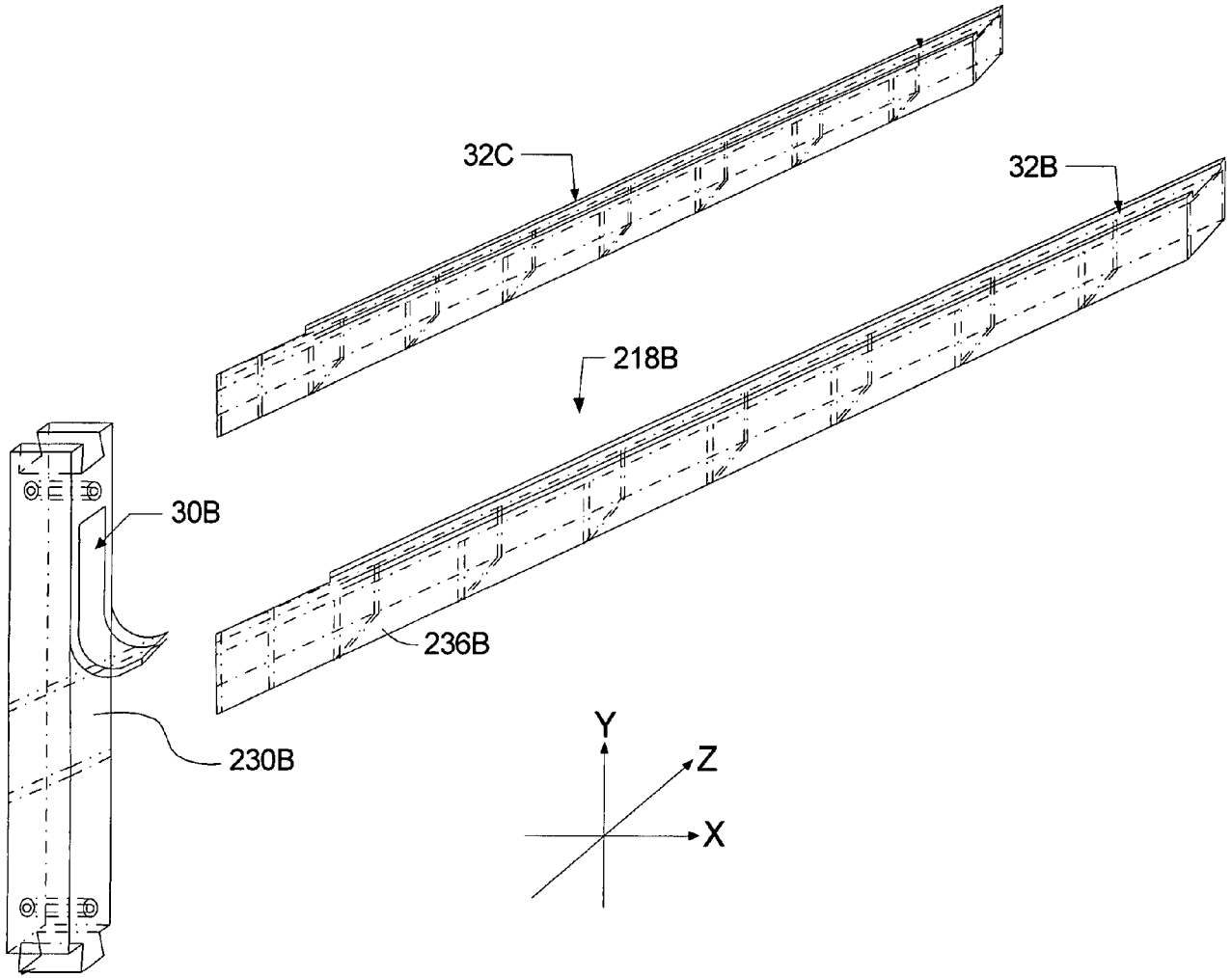
FIG. 2B is a perspective view of an alternative embodiment of one of the frames of FIG. 1.

FIG. 2B is a perspective view of another embodiment of a frame 218B including the base region 30B and a first cantilevering region 32B that can be used as one of the frames 18A–22B in FIG. 1. In this embodiment, the base region 30B and the first cantilevering region 32B are manufactured as a two-piece assembly with the base region 30B and the first cantilevering region 32B made as separate components that are later secured together. This design can allow for easier attachment of the base region 30B to the rigid structure 14. Further, this design can be easier to manufacture.

Figure 3:
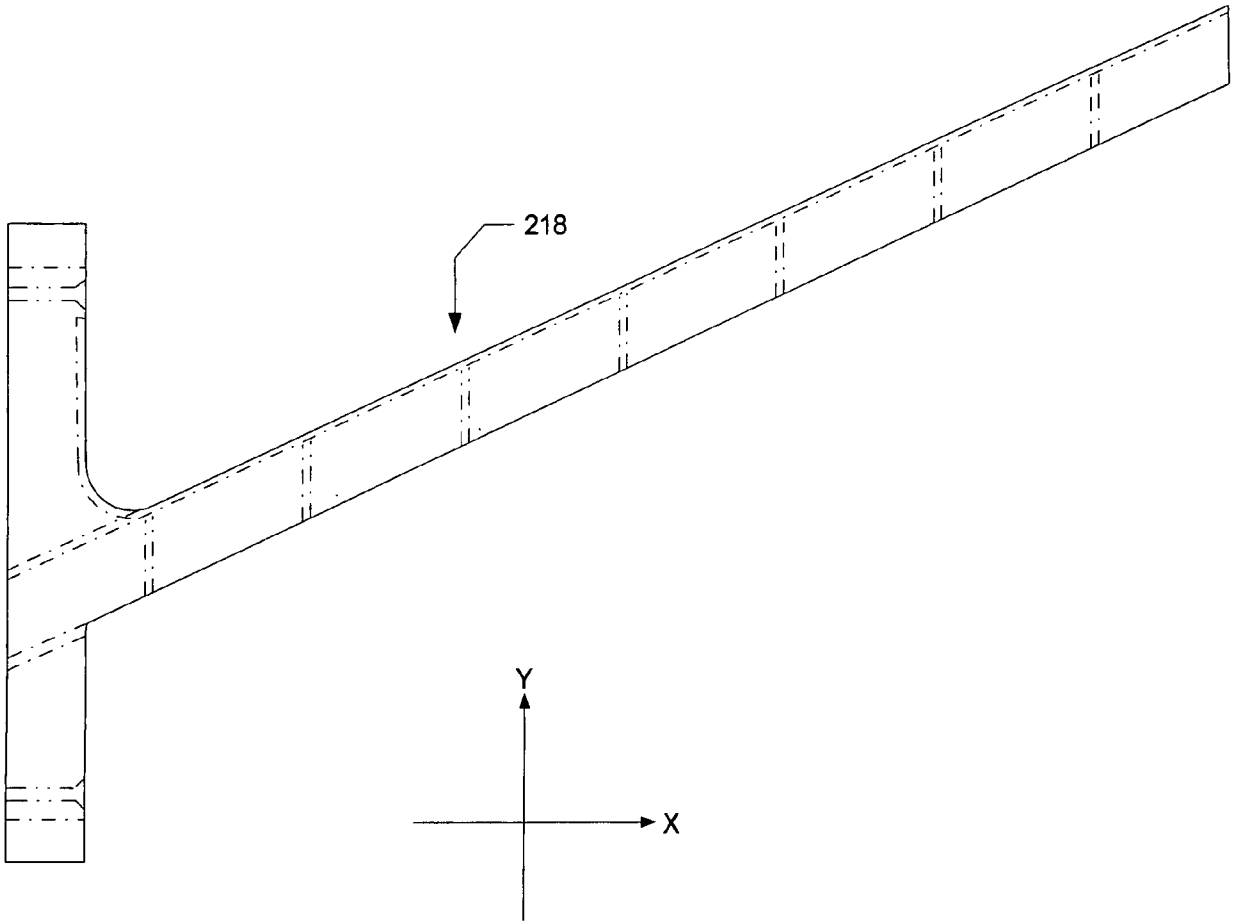
FIG. 3 is a side view of the frame of FIG. 2.

FIG. 2B also illustrates a second cantilevering region 32C. In one embodiment, the first cantilevering region 32B or the second cantilevering region 32C can be selectively and detachably secured to the base region 30B. The second cantilevering region 32C can be short and/or at a different angle than the first cantilevering region 32B. With this design, longer or shorter cantilevering regions 32B, 32C can be added as necessary to the base region 30B without removing the base region 30B from the rigid structure 14. This can allow the assembly to be easily changed to receive alternatively sized pieces of sports equipment. In one embodiment, the base region 30B includes a base aperture 230B that is sized and shaped to receive the proximal end 236B of the respective cantilevering region 32B, 32C. With this design, each of the cantilevering regions 32B, 32C can be alternatively, partly and selectively inserted into the base region 30B. FIG. 3 is a side view of the frame 218 from FIG. 2A.

Figure 4C:
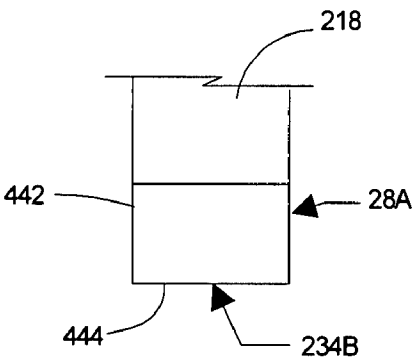
FIGS. 4A–4C are alternative views of a portion of the frame of FIG. 2.
Figure 4B:
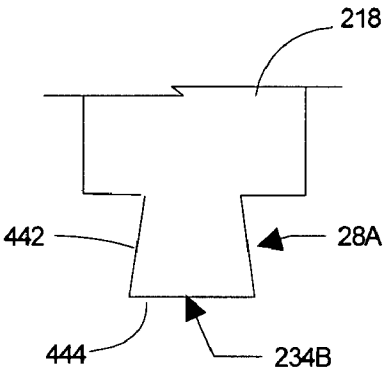
Figure 4A:
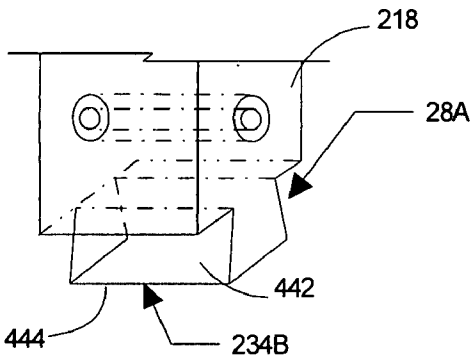

FIGS. 4A–4C are alternative views of one embodiment of the first coupling component 28A. In this embodiment, the first coupling component 28A is a protrusion that is integrally formed into the bottom 234B of the frame 218. The protrusion is defined by a pair of opposed protrusion walls 442 that converge away from the bottom 234B, and a protrusion top 444 that is flat.

Figure 5C:
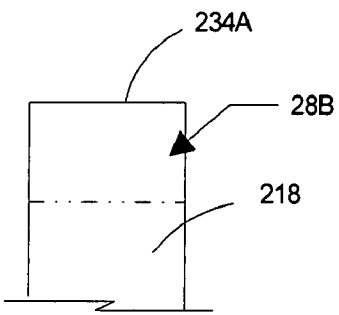
FIGS. 5A–5C are alternative views of another portion of the frame of FIG. 2.
Figure 5B:
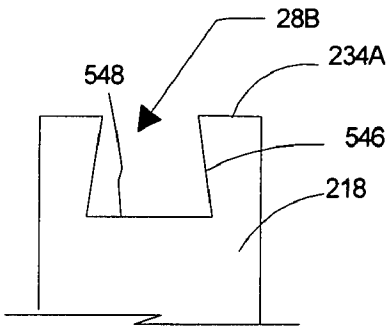
Figure 5A:
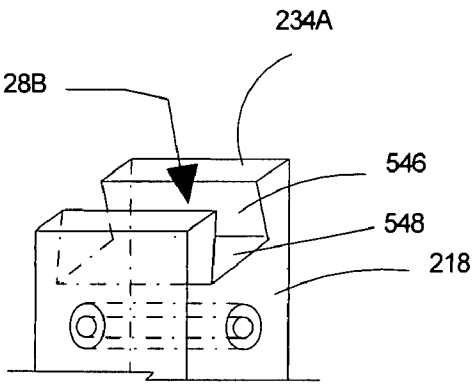

FIGS. 5A–5C are alternative views of one embodiment of the second coupling component 28B. In this embodiment, the second coupling component 28B is a slot that is integrally formed into the top 234A of the frame 218. The slot defines a pair of opposed slot walls 546 that diverge away from the top 234A, and a slot bottom 548 that is flat.

Figure 6:
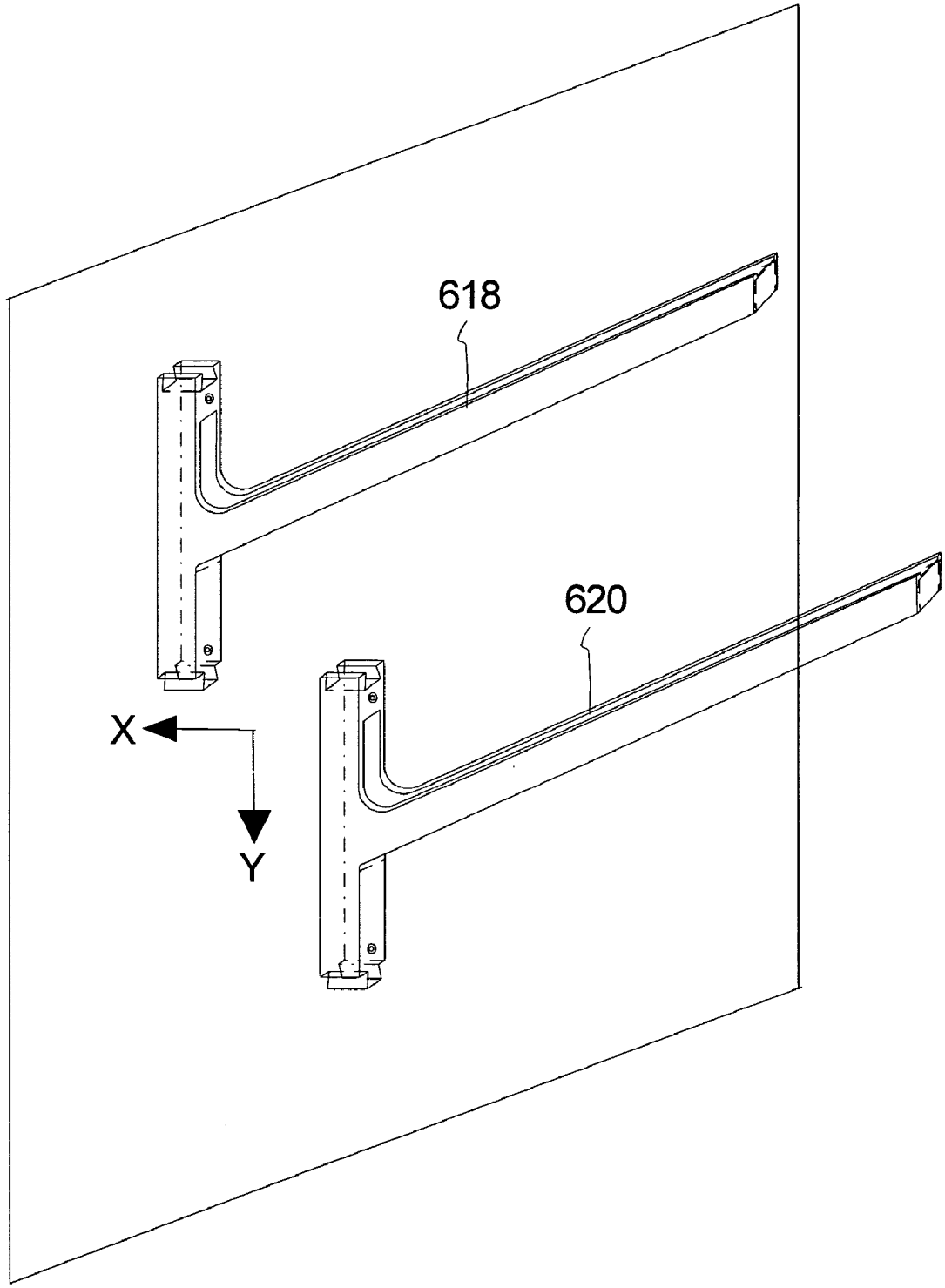
FIG. 6 illustrates a portion of two frames being coupled together.

FIG. 6 illustrates a portion of an upper frame 618 and a lower frame 620 that are uncoupled. In this position, the lower frame 620 can be moved along the X axis relative to the upper frame 618 to couple the frames 618, 620 together. When coupled, the frames 618, 620 are inhibited from being moved relative to each other along the Y axis. With this design, the lower frame 620 can be moved along the X axis to selectively couple and decouple the frames 618, 620.

Figure 7:
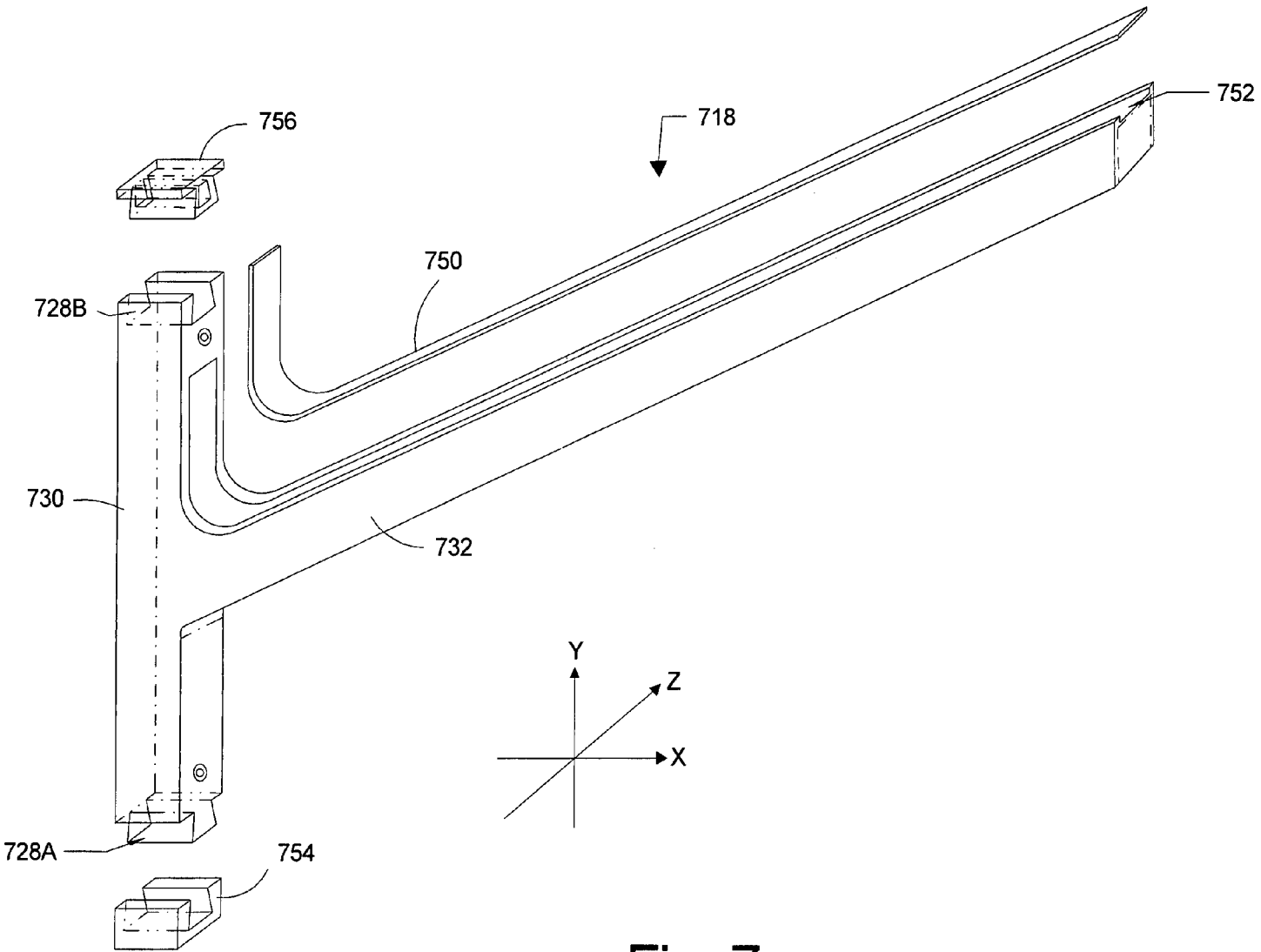
FIG. 7 is an exploded perspective view of another embodiment of the frame.

FIG. 7 is an exploded, perspective view of another embodiment of the frame 718. In this embodiment, the cantilevering region 732 and a portion of the base region 730 includes a padded area 750 that protects the piece of sports equipment. The design of padded area 750 can vary. In one embodiment, the padded area 750 is a piece of resilient material that fits into a groove 752 in the frame 718. Alternatively, for example, the padded area 750 can be a piece of resilient material that encircles a portion of the cantilevering region 732 and the base region 730 or the padded area 750 can be secured with an adhesive to the frame 718.

Additionally, in one embodiment, the storage system can include a first component cover 754 that covers the first coupling component 728A of the frame 718 and a second component cover 756 that covers the second coupling component 728B of the frame 718. In one embodiment, each cover 754, 756 is a cap made of a resilient material that is sized and shaped to snuggly fit over the respective coupling component 728A, 728B. Alternatively, each cover 754, 756 can sized and shaped to mate with the respective coupling component 728A, 728B. For example, the first component cover 754 can be sized and shaped somewhat similar to the second coupling component 728B and the second component cover 756 can be sized and shaped somewhat similar to the first coupling component 728A. The covers 754 and 756 can be injection molded.

It is to be understood that the storage system 12 disclosed herein is merely illustrative of the presently preferred embodiments of the invention and that no limitations are intended to the details of construction or design herein shown other than as described in the appended claims.

What is claimed is:

1. A storage system for securing a first piece of sports equipment and a second piece of sports equipment to a rigid structure, the storage system comprising:

a first storage subassembly including a left first frame and a spaced apart right first frame that are attached to the rigid structure, the first frames cooperating to support the first piece of sports equipment; wherein a distance between the left first frame and the right first frame can be selectively and independently adjusted prior to attachment of the first frames to the rigid structure; and a second storage subassembly including a left second frame and a spaced apart right second frame, the second frames being selectively attached to the first storage subassembly, the second frames cooperating to support the second piece of sports equipment; wherein a distance between the left second frame and the right second frame can be selectively and independently adjusted prior to attachment of the second frames to the first storage subassembly.

2. The storage system of claim 1 wherein the left first frame includes a first coupling component and the left second frame includes a second coupling component that engages the first coupling component to selectively couple the left second frame to the left first frame.

3. The storage system of claim 1 wherein each first frame includes a first coupling component and each second frame includes a second coupling component, wherein the second coupling component of the left second frame engages the first coupling component of the left first frame to selectively couple the left second frame to the left first frame, and wherein the second coupling component of the right second frame engages the first coupling component of the right first frame to selectively couple the right second frame to the right first frame.

4. The storage system of claim 1 wherein the each frame includes a first coupling component and a second coupling component, wherein the second coupling component of the left second frame engages the first coupling component of the left first frame to selectively couple the left second frame to the left first frame, and wherein the second coupling component of the right second frame engages the first coupling component of the right first frame to selectively couple the right second frame to the right first frame.

5. The storage system of claim 4 further comprising a first component cover that covers the first coupling component of one of the second frames and a second component cover that covers the second coupling component of one of the first frames.

6. The storage system of claim 1 wherein at least one of the frames includes a base region that is positioned adjacent to the rigid structure and a cantilevering region that cantilevers away from the base region.

7. The storage system of claim 6 wherein the cantilevering region is at an acute angle relative to the base region.

8. The storage system of claim 6 wherein the cantilevering region includes a padded area that engages the piece of sports equipment.

9. The storage system of claim 6 wherein the cantilevering region is selectively secured to the base region.

10. A combination comprising a first piece of sports equipment designed to ridden by user, a second piece of sports equipment designed to ridden by user, and a storage system designed to be attached to a rigid structure, the storage system comprising:

a first storage subassembly including a left first frame and a spaced apart right first frame that are coupled to the rigid structure, the first frames cooperating to support the first piece of sports equipment; wherein the first frames are not directly connected together; and a second storage subassembly including a left second frame and a spaced apart right second frame, the second frames being selectively coupled to the first storage subassembly, the second frames cooperating to support the second piece of sports equipment; wherein the second frames are not directly connected together;

wherein each of the frames includes a base region that is positioned adjacent to the rigid structure and a cantilevering region that cantilevers away from the base region at an acute angle, wherein the base region of each frame includes a first coupling component and a spaced apart second coupling component, wherein the second coupling component of the left second frame engages the first coupling component of the left first frame to selectively couple the left second frame to the left first frame, and wherein the second coupling component of the right second frame engages the first coupling component of the right first frame to selectively couple the right second frame to the right first frame.

11. The combination of claim 10 wherein the storage system further comprises a first component cover that covers the first coupling component of one of the second frames and a second component cover that covers the second coupling component of one of the first frames.

12. A method for securing a first piece of sports equipment and a second piece of sports equipment to a rigid structure, the method comprising the steps of:

fixedly securing a first storage subassembly to the rigid structure, the first storage subassembly including a left first frame and a spaced apart right first frame that cooperate to support the first piece of sports equipment; wherein a distance between the left first frame and the right first frame can be selectively and independently adjusted prior to fixedly securing the first frames to the rigid structure; and selectively coupling a second storage subassembly to the first storage subassembly, the second storage subassembly including a left second frame and a spaced apart right second frame that cooperate to support the second piece of sports equipment; wherein a distance between the left second frame and the right second frame can be selectively and independently adjusted prior to coupling the second frames to the first storage subassembly.

13. The method of claim 12 wherein the step of selectively coupling includes the step of selectively coupling a first coupling component of the left first frame to a second coupling component of the left second frame.

14. The method of claim 12 wherein each first frame includes a first coupling component and each second frame includes a second coupling component, wherein the second coupling component of the left second frame engages the first coupling component of the left first frame to selectively couple the left second frame to the left first frame, and wherein the second coupling component of the right second frame engages the first coupling component of the right first frame to selectively couple the right second frame to the right first frame.

15. The method of claim 12 wherein at least one of the frames includes a base region that is positioned adjacent to the rigid structure and a cantilevering region that cantilevers away from the base region.

16. A storage system for securing a first piece of sports equipment to a rigid structure, the storage system comprising:

a first storage subassembly including a left frame and a spaced apart right frame that are coupled to the rigid structure, the frames cooperating to support the first piece of sports equipment, each frame including a generally straight base region that is positioned adjacent to the rigid structure and a generally straight cantilevering region that cantilevers away from the base region at an acute angle, wherein the cantilevering region is selectively secured to the base region; and wherein the cantilevering region of each frame cooperate to support the first piece of sports equipment.

17. The storage system of claim 16 wherein at least one of the cantilevering regions includes a padded area that engages the piece of sports equipment.

18. The storage system of claim 16 wherein the first frames are not directly connected together.

19. The storage system of claim 16 further comprising a second storage subassembly including a left second frame and a spaced apart right second frame, the second frames being selectively coupled to the first storage subassembly, the second frames cooperating to support a second piece of sports equipment; wherein the second frames are not directly connected together.

20. The storage system of claim 16 wherein each of the frames is fixedly secured to the support structure.

* * * * *